US009797335B2

(12) United States Patent
Hayashi et al.

(10) Patent No.: US 9,797,335 B2
(45) Date of Patent: Oct. 24, 2017

(54) METHOD FOR MANUFACTURING CYLINDER BLOCK

(71) Applicant: NISSAN MOTOR CO., LTD., Yokohama-shi, Kanagawa (JP)

(72) Inventors: Mitsuo Hayashi, Kawasaki (JP); Yoshiaki Miyamoto, Yokohama (JP); Daisuke Terada, Yokohama (JP); Eiji Shiotani, Kawasaki (JP); Yoshitsugu Noshi, Yokohama (JP); Kazuaki Taniguchi, Isehara (JP); Takafumi Watanabe, Chigasaki (JP); Kiyokazu Sugiyama, Chigasaki (JP); Hirotaka Miwa, Yokohama (JP)

(73) Assignee: NISSAN MOTOR CO., LTD., Yokohama-shi (JP)

( * ) Notice: Subject to any disclaimer, the term of this patent is extended or adjusted under 35 U.S.C. 154(b) by 0 days.

(21) Appl. No.: 14/367,590

(22) PCT Filed: Nov. 5, 2012

(86) PCT No.: PCT/JP2012/078597
§ 371 (c)(1),
(2) Date: Jun. 20, 2014

(87) PCT Pub. No.: WO2013/094323
PCT Pub. Date: Jun. 27, 2013

(65) Prior Publication Data

US 2014/0345135 A1 Nov. 27, 2014

(30) Foreign Application Priority Data

Dec. 22, 2011 (JP) ..... 2011-281317

(51) Int. Cl.
*C23C 4/02* (2006.01)
*F02F 1/00* (2006.01)
(Continued)

(52) U.S. Cl.
CPC ..... *F02F 1/00* (2013.01); *C23C 4/02* (2013.01); *C23C 4/14* (2013.01); *C23C 4/16* (2013.01);
(Continued)

(58) Field of Classification Search
CPC .... F02F 1/00; F02F 1/102; C23C 4/16; C23C 4/14; C23C 4/02; Y10T 29/49272
See application file for complete search history.

(56) References Cited

U.S. PATENT DOCUMENTS 7,851,046 B2 * 12/2010 Nishimura ..... C23C 4/02 29/888.061
2010/0316798 A1 12/2010 Takahashi et al.
2011/0023667 A1 2/2011 Kume et al.

FOREIGN PATENT DOCUMENTS

JP 2005-256648 A 9/2005
JP 2006-152858 A 6/2006
(Continued)

OTHER PUBLICATIONS

U.S. Appl. No. 14/359,829, filed May 21, 2014, Taniguchi et al.
U.S. Appl. No. 14/366,506, filed Jun. 18, 2014, Miwa et al.

*Primary Examiner* — Sarang Afzali
*Assistant Examiner* — Ruth G Hidalgo-Hernandez
(74) *Attorney, Agent, or Firm* — Foley & Lardner LLP

(57) ABSTRACT

In a method for manufacturing a cylinder block provided with cylinder bores, the cylinder block is held by a clamp device, stress is generated in the cylinder block by a holding force of the clamp device to duplicate deformations of the cylinder bores after assembling hearing caps thereon, boring is carried out with the cylinder bores deformed in a condition where the stress is generated, and a thermally sprayed coating is formed, after the boring, on each inner surfaces of the cylinder bores deformed in the condition where the stress is generated. According to the method for manufacturing a
(Continued)

cylinder block, superior cylindricity, after assembling the bearing caps, of the cylinder bores on each of which the thermally sprayed coating is formed can be brought, and workability degradation of finishing works (honing) for each inner surface of the cylinder bores (thermally sprayed coatings) can be restricted.

4 Claims, 8 Drawing Sheets

(51) Int. Cl.
*C23C 4/14* (2016.01)
*C23C 4/16* (2016.01)
*F02F 1/10* (2006.01)

(52) U.S. Cl.
CPC ..... *F02F 1/102* (2013.01); *Y10T 29/49272* (2015.01)

(56) References Cited

FOREIGN PATENT DOCUMENTS

| | | | | |
|---|---|---|---|---|
| JP | 2006-291336 | A | | 10/2006 |
| JP | 2007154865 | A | * | 6/2007 |
| JP | 2007-224842 | A | | 9/2007 |
| JP | 2007-270620 | A | | 10/2007 |
| JP | 2008-223503 | A | | 9/2008 |
| JP | 2008-232734 | A | | 10/2008 |
| JP | 2009-197309 | A | | 9/2009 |
| JP | 2009-228130 | A | | 10/2009 |

* cited by examiner

METHOD FOR MANUFACTURING CYLINDER BLOCK

TECHNICAL FIELD

The present invention relates to a method for manufacturing a cylinder block in which a spray coating is formed on each inner surface of cylinder bores.

BACKGROUND ART

In view of power improvement, fuel consumption improvement, emission performance improvement, downsizing or light-weighting of an internal combustion engine, elimination of a cylinder liner to be applied to a cylinder bore(s) of an aluminum cylinder block is desired. As one of techniques instead of a cylinder liner, it is known that a thermally sprayed coating is formed on an inner surface of a cylinder bore by use of ferrous material (for example, see Patent Literature 1 listed below).

CITATION LIST

Patent Literature

Patent Literature 1: Japanese Unexamined Patent Publication No. 2006-291336

SUMMARY OF INVENTION

In a case where bearing caps are assembled, by bolts, on a cylinder block on which a thermally sprayed coating is formed on an inner surface of a cylinder bore(s), the cylinder bore is deformed due to stress generated by fastening them. According to this deformation of the cylinder bore, cylindricity of the cylinder bore is degraded.

With respect to the cylinder bore on which the thermally sprayed coaling is formed and of which cylindricity is degraded, its inner surface is deformed to have not a precise circular cylindrical shape but an ellipsoidal cylindrical shape or an elongate circular cylindrical shape. Therefore, when carrying out finishing works (honing) with the cylinder bore on which the thermally sprayed coating is formed and of which cylindricity is degraded, it is required to modify the cylinder bore to have a precise circular cylindrical shape and thereby workability becomes degraded.

Therefore, an object of the present invention is to restrict workability degradation of finishing works, carried out after assembling bearing caps, of an inner surface of a cylinder bore on which a thermally sprayed coating is formed.

An aspect of the present invention provides a method for manufacturing a cylinder block provided with a plurality of cylinder bores, the method comprising: holding the cylinder block by a clamp device; generating stress in the cylinder block by a holding force of the clamp device to duplicate deformations of the plurality of cylinder bores after assembling bearing caps thereon; carrying out boring with the plurality of cylinder bores that are deformed in a condition where the stress is generated, respectively; and forming a thermally sprayed coating on each inner surfaces of the plurality of cylinder bores, after the boring, that are deformed in the condition where the stress is generated.

DESCRIPTION OF EMBODIMENTS

Hereinafter, embodiments will be explained with reference to the drawings.

First Embodiment

Figure 1:
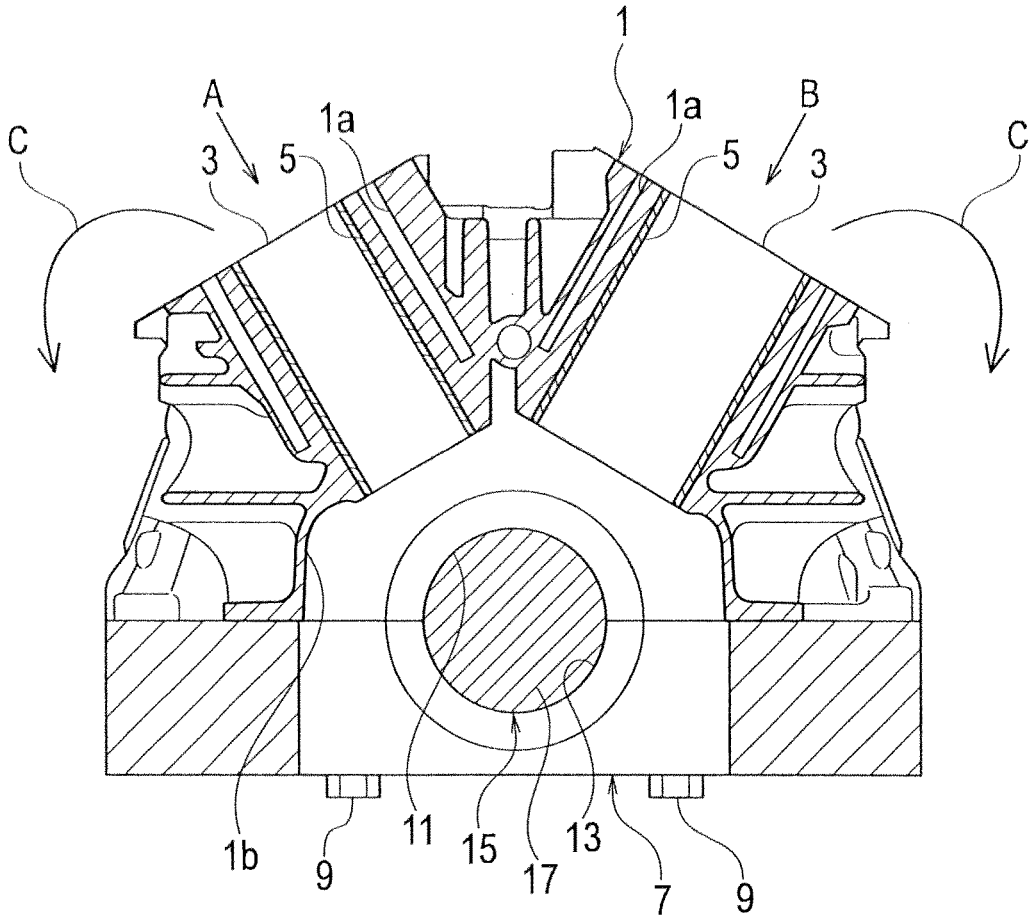
[FIG. 1] It is a cross-sectional view showing a condition where hearing caps are assembled on a cylinder block according to a first embodiment.

A cylinder block 1 according to the present embodiment shown in FIG. 1 is applied to a V-type engine for an automobile. The cylinder block 1 is made of aluminum alloy, and thermally sprayed coatings 5 are formed on inner surfaces of its cylinder bores 3. FIG. 1 shows a condition where hearing caps 7 and a crankshaft 15 are assembled on the cylinder block 1 in which the thermally sprayed coatings are formed on the inner surfaces of the cylinder bores 3 in an after-explained thermal spraying process.

By forming the thermally sprayed coatings 5 on the inner surfaces of the cylinder bores 3, properties such as an anti-abrasion property are improved. A method for forming the thermally sprayed coating 5 is known, and done by inserting a not-shown thermal spray gun into the cylinder bore 3 while rotating it, reciprocating it along an axial direction, and injecting melted droplets of coating material from a nozzle at an end of the thermal spray gun to attach them onto the inner surface of the cylinder bore 3. A wire made of ferrous material to be the coating material is continuously supplied to the nozzle from an outside of the thermal spray gun, and then the melted droplets are generated by melting the wire by a heat source such as plasma arc (Plasma Spray Coating).

The bearing caps 7 are fastened, by bolts 9, on a bottom surface of the cylinder block 1 shown in FIG. 1. Journals 17 of the crankshaft 15 are rotatably held between bearings 13 of the bearing caps 7 and bearings 11 of the cylinder block 1.

An oil pan (not shown) is attached to an opposite bottom surface of the crankcase 1*b* to the cylinder block 1, and a cylinder head (not shown) is attached to an opposite upper surface of the cylinder block 1 to the crankcase 1*b*.

Figure 3:
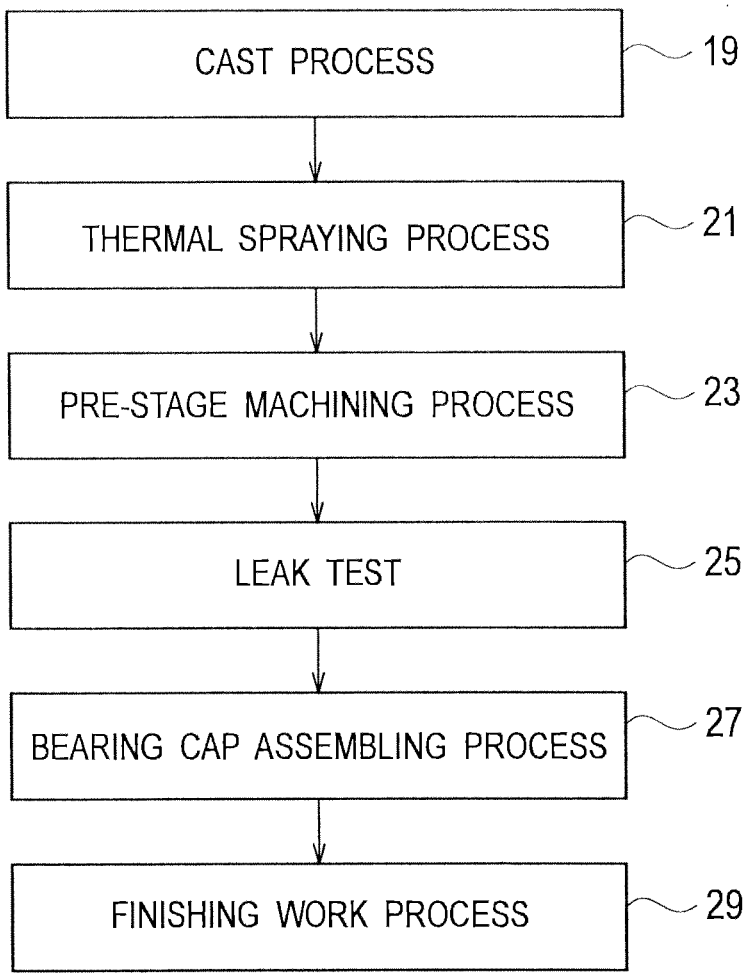
[FIG. 3] It is a manufacturing process diagram of the cylinder block according to the first embodiment.

FIG. 3 shows manufacturing processes of the cylinder block 1 according to the present embodiment. The cylinder block 1 is cast in a cast process 19, and then the thermally sprayed coatings 5 are formed on the inner surfaces of the cylinder bores 3 in a thermal spraying process 21. Subsequently, machining (such as cutting) for outer sides of the cylinder block 1 is carried out in a pre-stage machining process 23, and then a leak test 25 is carried out.

The leak test 25 is a test for fluid leaks, such as coolant leaks from a jacket 1*a*, lubrication oil leaks in the crankcase 1*b* and so on. A leak test is conventionally well-known. For example, it is carried out by adding pressure to an inside of the water jacket 1*a* and an inside of the crankcase 1*b* in a state where they are sealed up, and then judging whether or not their inner pressures are maintained not lower than a prescribed value after predetermined time has elapsed.

Then, through a hearing cap assembling process 27 for assembling the bearing caps 7, a finishing work process 29 for processing finishing works such as honing of the cylinder bores 3 is carried out. The honing is a process for abrading the inner surfaces of the cylinder bores 3 precisely, so that the above-explained thermally sprayed coatings 5 are abraded. By the honing, high-accuracy cylindricity of the cylinder bores 3 is brought surely. In the honing, dummy cylinder heads are also attached to the cylinder block 1.

Figure 2:
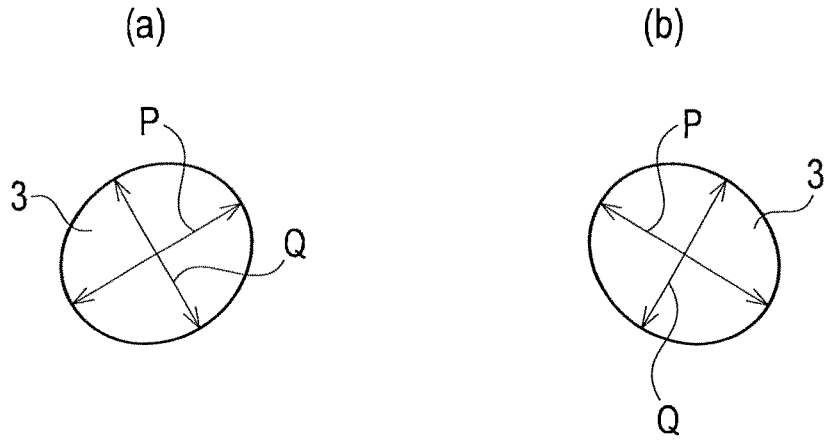
[FIG. 2](*a*) is a schematic diagram showing a deformation of a cylinder bore viewed along an arrow A in FIG. 1, and (*b*) is a schematic diagram showing a deformation of a cylinder bore viewed along an arrow B in FIG. 1.

When the bearing caps 7 is fastened, by the bolts 9, on the cylinder block 1 in the bearing cap assembling process 27 prior to the above-explained finishing work (honing) process 29, stress is generated in the cylinder block 1. The cylinder block 1, i.e. the cylinder bore(s) 3 is deformed due to the stress, so that the cylindricity becomes degraded. Specifically, as shown in FIG. 2(*a*) that is a schematic diagram viewed along an arrow A in FIG. 1 and in FIG. 2(*b*) that is a schematic diagram viewed along an arrow B in FIG. 1, a diameter P of the cylinder bore(s) 3 along a lateral direction in FIG. 1 becomes longer than a diameter Q along a direction perpendicular to the lateral direction, so that a cross-sectional shape of the cylinder bore(s) 3 is deformed to have an ellipsoidal shape or an elongate circular shape.

Such a deformation is generated by lateral inclinations of portions near the cylinder bores 3, that are caused by fastening of the bolts 9 positioned on both lateral sides with respect to a center between both banks of the cylinder bores 3, with respect to the center as a boundary as indicated by arrows C in FIG. 1.

If the cylinder bore(s) 3 having an ellipsoidal shape or an elongate circular shape due to the above-explained deformation processed by the honing, an abraded amount in regions along the short diameter becomes larger than an abraded amount in regions along the long diameter. The regions along the short diameter are abraded more, so that the cross-sectional shape of the cylinder bore(s) 3 is made precisely circular. However, in this case, it is required to from the thermally sprayed coating 5 thick preliminarily in consideration of the abraded amount of the regions along the short diameter, so that much coating material is needed.

Figure 4:
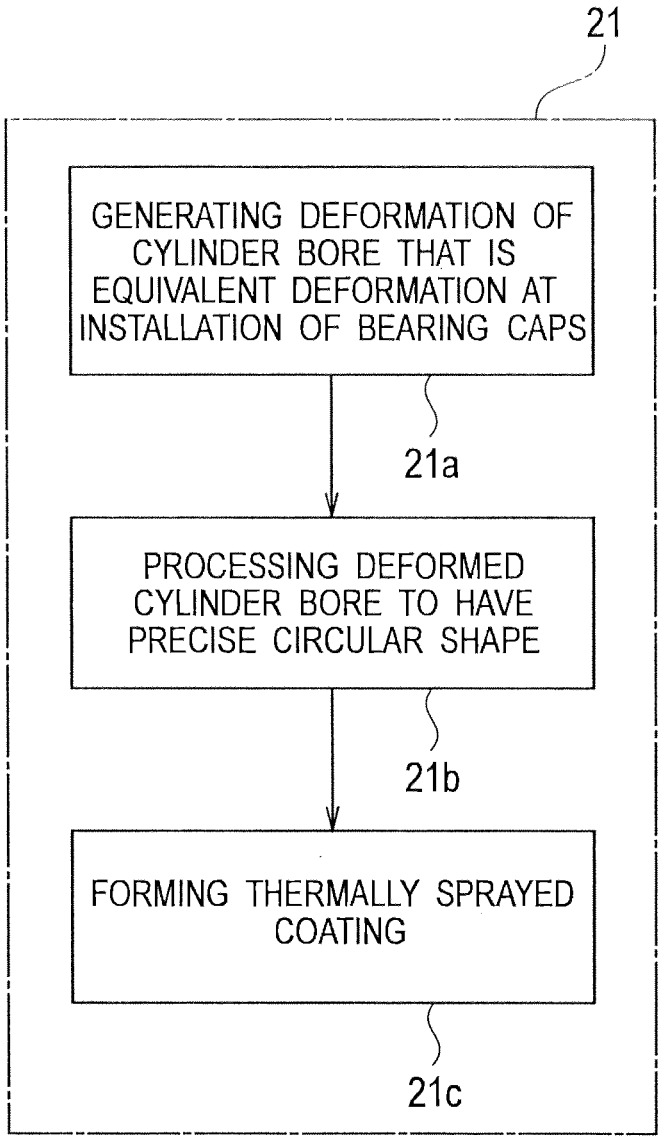
[FIG. 4] It is a flowchart showing operations in a thermal spraying process in the flowchart shown in FIG. 3.

Therefore, in the present embodiment, operations shown in FIG. 4 are carried out in the thermal spraying process 21 prior to the bearing cap assembling process 27 and the finishing work (honing) process 29. Namely, by used of a clamp device (clamping means) 31 shown in FIG. 5, deformations of the cylinder bores 3 to be caused by assembling the bearing caps 7 on the cylinder block 1 are intentionally generated (operation 21*a*).

On a bed 37 of the clamp device 31, support protrusions 39 for supporting the cylinder block 1 and oil-pressure cylinders (clamping mechanisms) 41 are provided. The support protrusions 39 support bottom surfaces (bearing cap mounting surfaces 43) of the cylinder block 1 near the bearings 11. Namely, the support protrusions 39 support portions near the bearings 11 from beneath (from a bottom side of the cylinder block 1). Each of the oil-pressure cylinders 41 is provided with a rod 41*b* that extends vertically from its main body 41*a* and can be stroked vertically, and a clamp arm 45 extending horizontally is attached to the rod 41*b*.

In a state where ends of the clamp arms 45 are located above upper surfaces 47 of side portions of the cylinder block 1, respectively, the rods 41*b* are moved downward by driving the oil-pressure cylinders 41. Namely, the clamp arms 45 clamp lower side-edges of the cylinder block 1 from above (from a head side of the cylinder block 1). Therefore, the cylinder block 1 is held firmly by the clamp arms 45 so as to endure works (works in the operations 21*a* to 21*c*), and stress is generated in the cylinder block 1 due to load application by the clamp arms 45. This will cause the deformations indicated by the arrows C that are to be generated when assembling the bearing caps 7 on the cylinder block 1. At this time, as shown in FIG. 5, a condition where the bearing caps 7 are assembled on the cylinder block 1 is duplicated by inserting a measurement instrument 30 for measuring inner diameters of the cylinder bore 3 into the cylinder bore 3 and monitoring the deformations in the cylinder block 1.

Here, an inner diameter(s) of a cylinder bore 3 of the cylinder block 1 in which the stress is not generated and an inner diameter(s) of the cylinder bore 3 in the cylinder block 1 on which the bearing caps 7 are assembled are preliminarily measured. Based on these measured results, the deformation of the cylinder bore 3 is monitored in the operation 21*a* shown in FIG. 5, and the condition where the bearing caps 7 arc assembled on the cylinder block 1 is duplicated. Note that it is substantially impossible to "perfectly duplicate" the condition where the bearing caps 7 are assembled on the cylinder block 1 by the clamp device 31, so that the "duplicate" used here means to vicariously duplicate the condition where the bearing caps 7 are assembled on the cylinder block 1.

Figure 5:
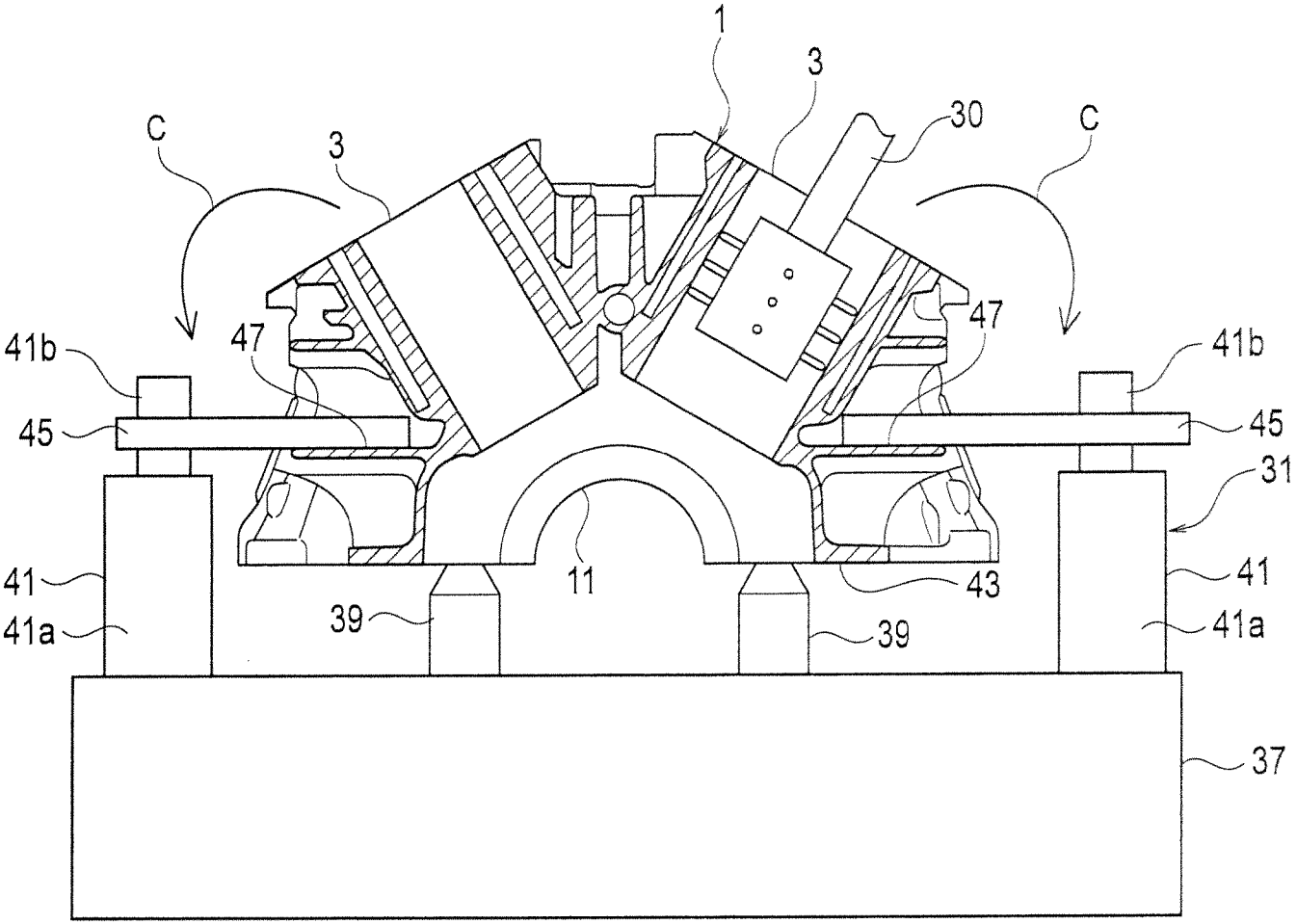
[FIG. 5] It is a cross-sectional view showing a condition where deformations by assembling bearing caps are generated in the cylinder bores by a clamp device.

In addition, although FIG. 5 shows a state where only one of the cylinder bores 3 is being measured, it is preferable to duplicate the condition where the bearing caps 7 are assembled on the cylinder block 1 while measuring all of the cylinder bores 3. However, it is acceptable to only one of the cylinder bores 3 is measured or to some of the cylinder bores 3 are measured (for example, a center cylinder bore 3 in each hank of a V6 engine, i.e. two cylinder bores 3 are measured). In addition, if a deformation of a particular single cylinder bore 3 correlates with deformations of other cylinder bores 3 and a measured value of the single cylinder bore 3 is consistent with deformations of all cylinder bores 3, it is acceptable that a measurement by the measurement instrument 30 is made only in the particular single cylinder bore 3.

Further, it is preferable to carry out a measurement by the measurement instrument 30 for every cylinder block 1. However, if measurements were made for one or more cylinder blocks 1 and consistency between the condition where the bearing caps 7 are assembled on the cylinder block 1 and an applied load by the clamp arms 45 (the oil-pressure cylinders 41) is brought, it is acceptable to carry out a measurement by the measurement instrument 30 for not every cylinder block 1.

Note that the measurement instrument 30 may be a contact-type measurement instrument, or a non-contact-type measurement instrument. Further, it is preferable to measure an inner diameter of the cylinder bore 3 at plural positions along its axis (three positions are measured in FIG. 5), and it is especially preferable to carry out a measurement focusing on one side including a cylinder head(s) that presents a larger deformation.

Figure 6:
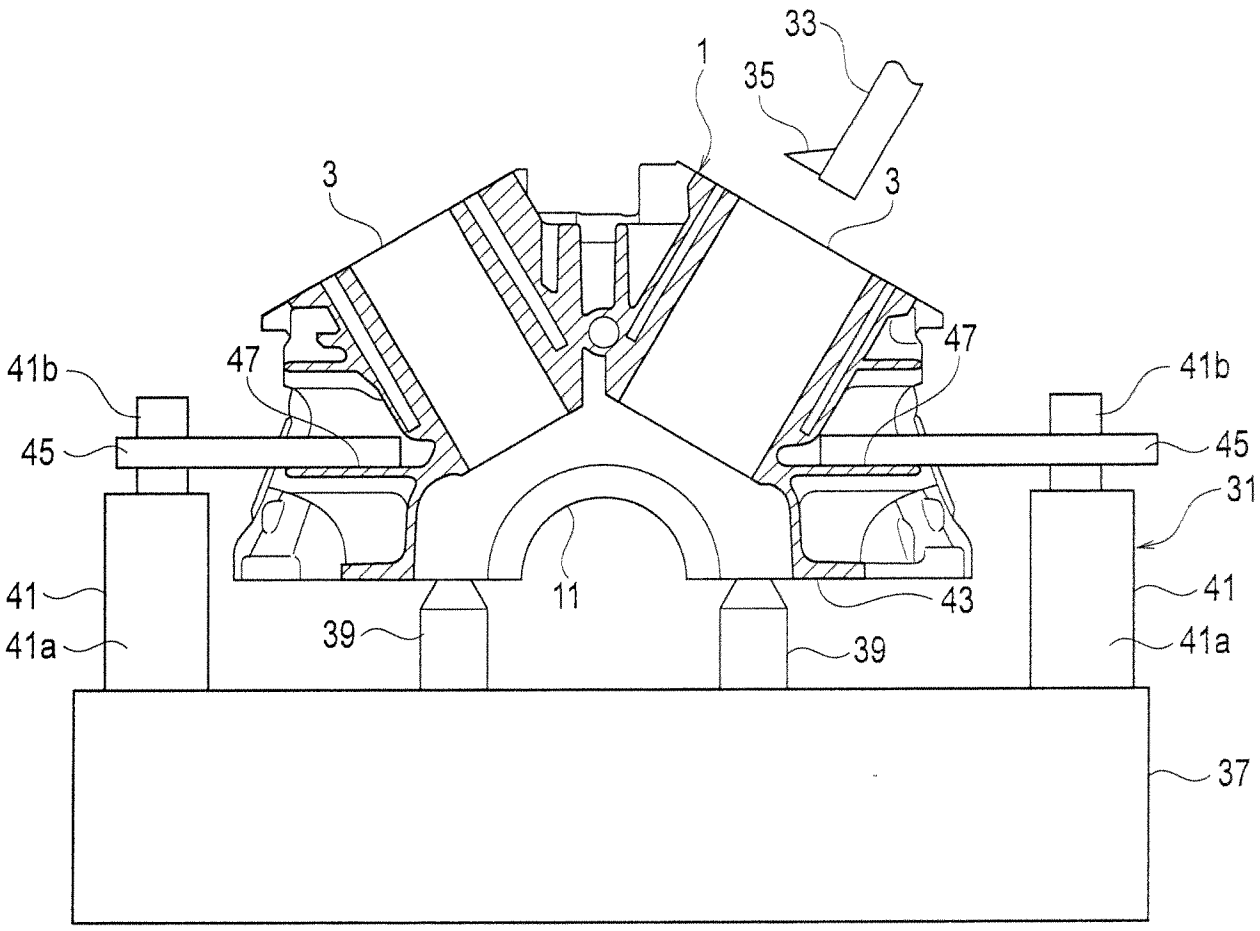
[FIG. 6] It is a cross-sectional view showing a boring process of the cylinder bore.

Subsequently, as shown in FIG. 6, a machining work (boring) is made in the condition where the deformation of the cylinder bore(s) 3 is intentionally generated so that the cross-sectional shape (an ellipsoidal shape or an elongate circular shape due to the deformation) of the cylinder bore 3 becomes a precisely circular shape (an exactly circular shape) (operation 21*b*). By the above machining work, cylindricity of the cylinder bore(s) 3 is corrected. As shown in FIG. 6, the above machining work is carried out by inserting a boring bar 33 into the cylinder bore 3 while rotating it to cut the inner surface of the cylinder bore 3 by a cutting blade 35 provided at an end of the boring bar 33.

Figure 7:
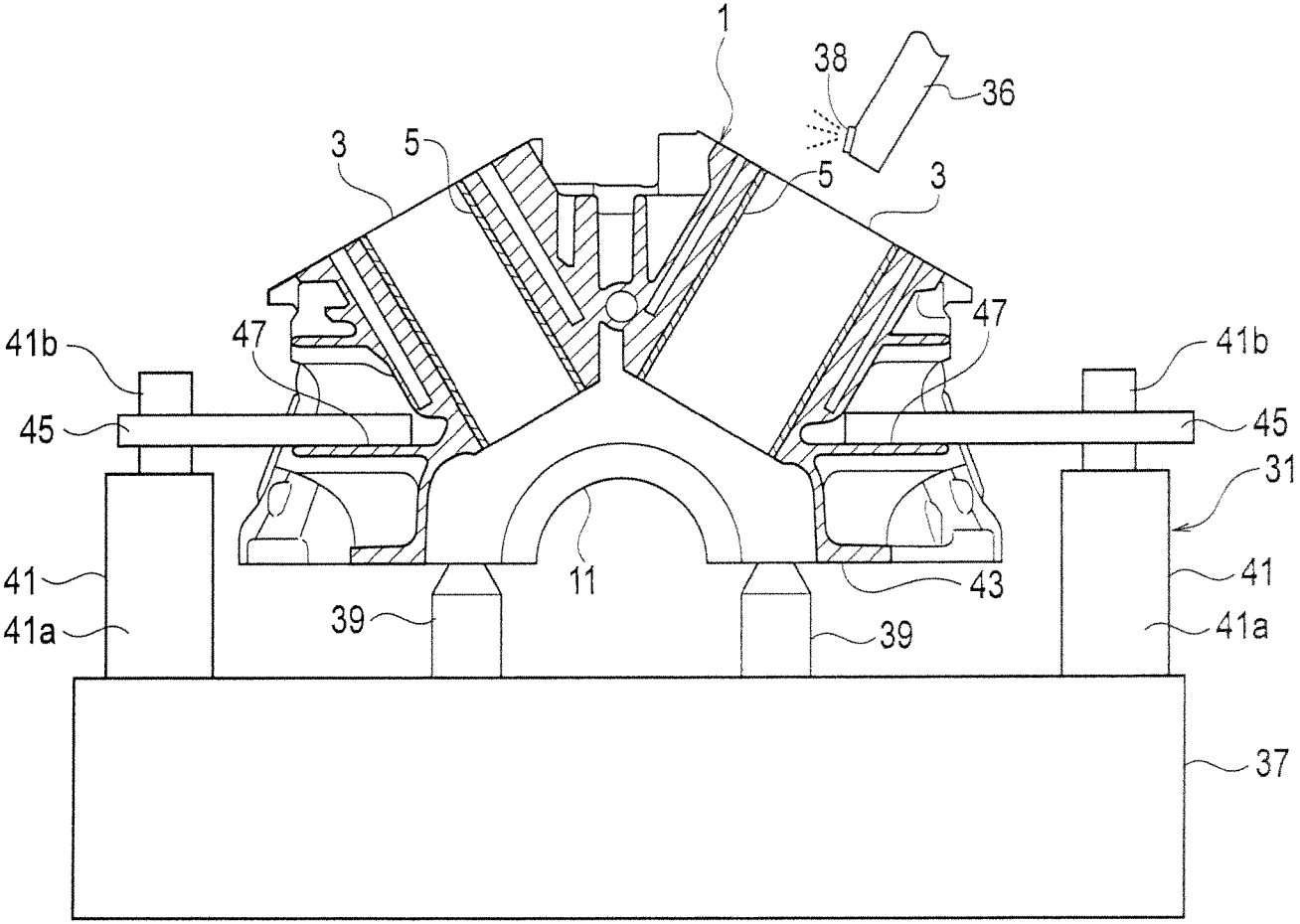
[FIG. 7] It is a cross-sectional view showing a thermal spraying process of the cylinder bore.

Subsequently, as shown in FIG. 7, the thermally sprayed coating(s) 5 is formed on the inner surface of the cylinder bore 3 by using known then spraying technique (operation 21*c*). Namely, coating material is attached onto the inner surface of the cylinder bore 3 by inserting a thermal spray gun 36 into the cylinder bore 3 while rotating it reciprocating it along an axial direction, and injecting melted droplets of the coating material from a nozzle 38 at an end of the thermal spray gun 36.

Figure 8:
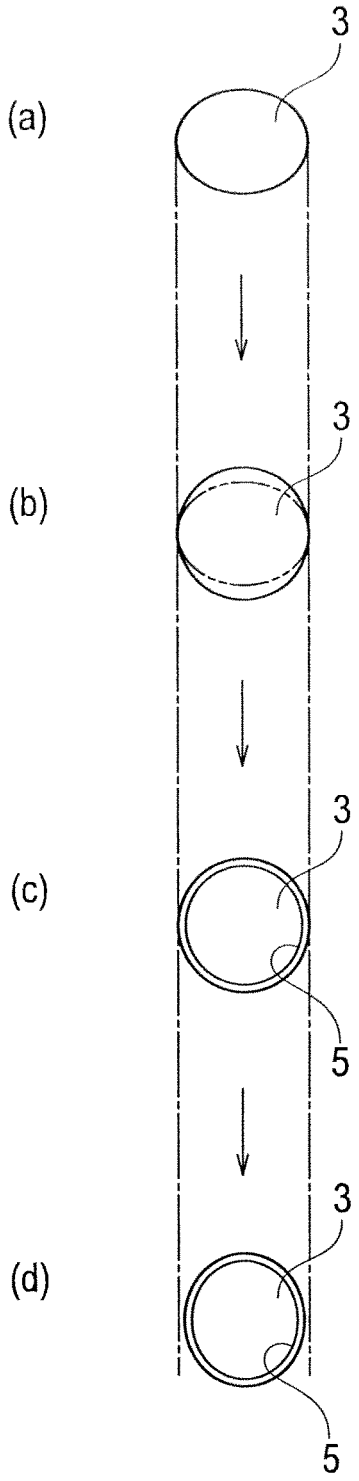
[FIG. 8] It is a schematic diagram showing deformations of a cylinder bore associated with the operations in FIG. 4.

Shapes of the cylinder bore 3 during processes of the operations 21*a* to 21*c* are shown in FIG. 8(*a*) to (*c*). Namely, as shown in FIG. 8(*a*), the deformation of the cylinder bore 3 in the condition where the bearing caps 7 are assembled on the cylinder block 1 is duplicated by the operation 21*a*. Subsequently, as shown in FIG. 8(*b*), the inner surface of the cylinder bore 3 is cut by the operation 21*b* (boring), and thereby good cylindricity of the cylinder bore 3 in the above-explained duplicated condition is ensured. Further, as shown in FIG. 8(*c*), the thermally sprayed coating 5 is formed on the inner surface of the cylinder bore 3 in the above-explained duplicated condition by the operation 21*c* (formation of the thermally sprayed coating 5).

After the above-explained thermal spraying process 21, holding (stress loading) of the cylinder block 1 by the clamp device 31 is released, and then the pre-stage machining process 23 and the leak test 25 are carried out sequentially (see FIG. 3). Since holding of the cylinder block 1 by the clamp device 31 is released in the pre-stage machining process 23 and the leak test 25, the duplicated deformations of the cylinder bores 3 are also cancelled. Therefore, the cylinder bore(s) 3 is deformed in a direction inverse to a direction of the deformation by the clamp device 31. Note that the directions inverse to each other are directions that are perpendicular to each other in a plane orthogonal to an axis of the cylinder bore 3.

Namely, if the cylinder bore 3 is deformed to have an ellipsoidal shape or an elongate circular shape expanded in a lateral direction as shown in FIG. 8(*a*) by the operation 21*a* the cylinder bore 3 whose deformation by the clamp device 31 is cancelled will have an ellipsoidal shape or an elongate circular shape expanded in a vertical direction perpendicular to the lateral direction as shown in FIG. 8(*d*) (because boring was carried out in the operation 21*b*).

After the leak test 25, the bearing caps 7 are assembled on the cylinder block 1 (a shape of the cylinder bore(s) 3 has the shape shown in FIG. 8(*d*)) in the bearing cap assembling process 27. After the hearing caps 7 are assembled on the cylinder block 1, stress due to fastening of the bolts 9 is generated in the cylinder block 1. As a result, the cylinder bores 3 arc deformed again, and thereby returned into the condition shown in FIG. 8(*c*).

Then, finishing works (honing) are made in the finishing work process 29 for the thermally sprayed coatings 5 of the cylinder bores 3 each having the circular shape shown in FIG. 8(*c*). When carrying out honing with the thermally sprayed coating(s) 5, the inner surface of the thermally sprayed coating 5 already has the circular (cylindrical) shape as shown in FIG. 8(*c*). Therefore, workings for correcting the cylindricity are not required when carrying out honing, and thereby working efficiency is improved (workability degradation is restricted). The inner surface of the cylinder bore(s) 3 (the thermally sprayed coating(s) 5) is improved further in its cylindricity by honing, and thereby has a precise circular shape.

According to the present embodiment, it is not required to correct the cylindricity of the cylinder bore(s) 3 (the thermally sprayed coating(s) 5) that is deformed as shown in FIG. 2 and thereby has an ellipsoidal shape or an elongate circular shape caused by assembling the bearing caps after forming the thermally sprayed coating 5. Namely, since it is not required to form the thermally sprayed coating(s) 5 thick in consideration of an abraded amount, it is not needed to use much coating material. Therefore, material costs can be restricted by elimination of a used amount of the coating material. In addition, since the used amount of the coating material is eliminated, working time for the thermally sprayed coating(s) 5 can he shortened.

Note that the thermal spraying process 21 is carried out following the cast process 19. In a case where the thermal spraying process 21 is carried out at a downstream of the manufacturing processes, e.g. directly before the finishing work process 29, the cylinder block 1 will be condemned if a casting failure is found at thermal spraying (especially, at boring for correcting cylindricity) In this case, process costs and working times required for processes from the cast process to the thermal spraying process (including the pre-stage machining process) are subject to be wasted.

In addition, by carrying out the thermal spraying process 21 directly after the cast process 19, modifications for a manufacturing line can he reduced, and facility costs can be decreased. If the thermal spraying process 21 is carried out at a downstream of the manufacturing processes, e.g. followed by the finishing work process 29, it is needed to implement the thermal spraying process 21 into the middle of an existing manufacturing line, so that extent of modifications for the line is subject to become large. In consideration of these matters, it is preferable that the thermal spraying process is carried out next after the cast process 19 as in the present embodiment.

Second Embodiment

A cylinder block 1A according to the present embodiment has a dimension that makes the deformations caused by assembling the bearing caps 7 smaller than those in the cylinder block 1 of the first embodiment (or, the cylinder block 1A is not deformed). Note that manufacturing processes and operations for manufacturing the cylinder block 1A of the present embodiment are the same as the manufacturing processes (see FIG. 3) and the operations (see FIG. 4) in the above-explained first embodiment.

Figure 9:
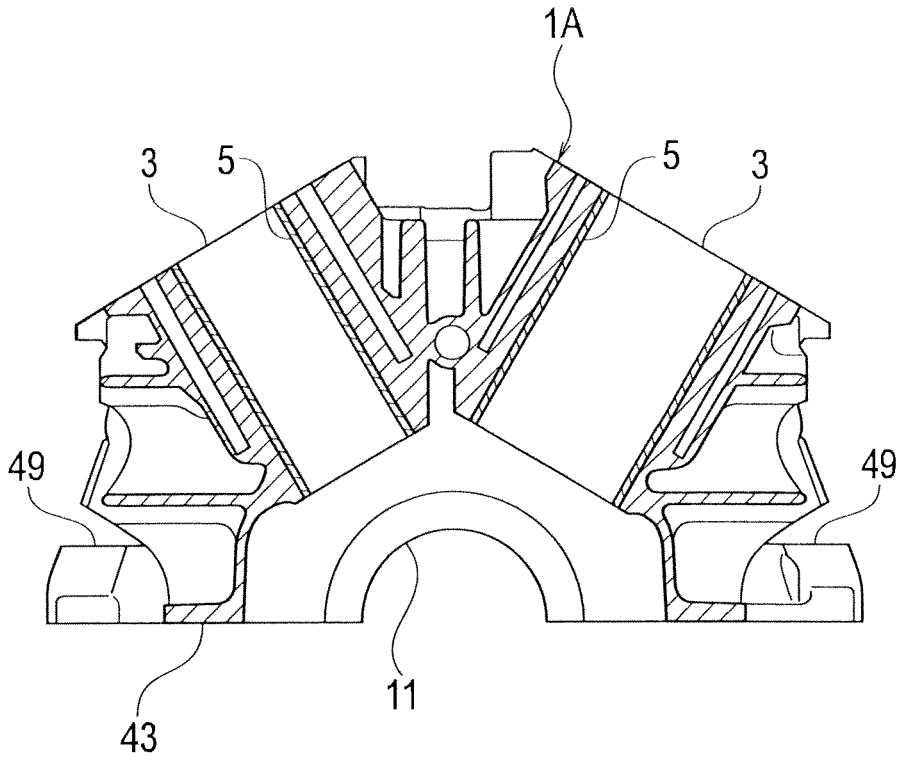
[FIG. 9] It is a cross-sectional view of a cylinder block according to a second embodiment.

Specifically, in the cylinder block 1A, cutout portions (stress absorbing portions) 49 for absorbing stress (i.e. for preventing stress from acting on the cylinder bores 3) are formed near the bearing cap mounting surfaces 43 on outer sides of the banks as shown in FIG. 9. The cutout portions 49 are formed just beneath clamped portions by the clamp arms 45 of the clamp device 31 (on sides of crankcase of the cylinder block 1A). By forming the cutout portions 49, rigidity near the cutout portions 49 is restricted to be low. In this manners, by restricting rigidity of some portions of the cylinder block 1A, stress generated when assembling the bearing caps 7 on the cylinder block 1A can be absorbed and thereby deformations of the cylinder bores 3 can be restricted.

Namely, even when the bearing caps 7 are fastened, by the bolts 9, on the cylinder block 1A in the present embodiment, deformations of the cylinder bores 3 are restricted and thereby their precisely (exactly) circular shapes can be kept. Therefore, according to the present embodiment, it is not required to correct the cylindricity of the cylinder bore(s) 3 when boring the inner surface of the cylinder bore 3 (the thermally sprayed coating 5) in the condition where the bearing caps 7 are assembled on the cylinder block 1A, similarly to the above-explained first embodiment. As a result, working efficiency is improved (workability degradation is restricted).

In addition, since it is not required to correct the cylindricity of the cylinder bore(s) 3 when boring the inner surface of the cylinder bore 3 (the thermally sprayed coating 5), it is not needed to use much coating material. Therefore, material costs can be restricted by elimination of a used amount of the coating material.

Instead of forming the above-explained cutout portions (stress absorbing portions) 49, following methods can be adopted. (1) If reinforcing portions (such as ribs) are formed primordially at the positions of the cutout portions 49, the ribs are removed (i.e. the cutout portions 49 are formed by removing the reinforcing portions from the cylinder block). (2) Portions corresponding to the cutout portions 49 are made thinner (i.e. the cutout portions 49 are formed by making their thickness smaller).

According to the above embodiments, the thermally sprayed coating is formed on the inner surface of the cylinder bore that has been worked to have a precise circular shape in the deformed condition equivalent to that when the bearing caps are assembled. Thus, the inner surface of the cylinder bore in the condition where the bearing caps have been assembled has promised cylindricity. Therefore, it is not required, in the finishing work (honing) of the coating surface, to correct the cylindricity, so that working efficiency can be improved (workability degradation can be restricted).

The entire contents of Japanese Patent Applications 2011-281317 (filed Dec. 22, 2011) are incorporated to this Specification by reference. Although the invention has been described above by reference to certain embodiments of the invention, the invention is not limited to the embodiments described above. Scope of the invention should be defined in view of Claims.

Note that each of the above embodiments is explained by taking the cylinder block 1 (1A) of a V-type engine for an automobile as an example. Since deformation of the cylinder block 1 caused by assembling the bearing caps is apparent in a V-type engine in which the cylinder bores 3 are formed on its both banks (excluding horizontally-opposed engine), the present invention is effective especially for a cylinder block of a V-type engine. However, the present invention can be applied to a cylinder block of other types of engines such as an inline engine, and thereby the above-explained effects can be brought similarly.

The invention claimed is:

1. A method for manufacturing a cylinder block of a V-type engine in which a plurality of cylinder bores is provided in a V-type arrangement, the method comprising:

a cast process for casting the cylinder block including the plurality of cylinder bores; and a thermal spraying process that is carried out next after the cast process, including:

(1) holding the cylinder block by a clamp device to duplicate deformations caused by bearing caps of the plurality of cylinder bores after assembling the bearing caps thereon by generating stress in the cylinder block by a holding force of the clamp device;

(2) boring the plurality of cylinder bores, while generating the stress in the cylinder block by the holding force of the clamp device, to correct the cylindricity of the cylinder bores; and (3) spraying melted droplets of coating material onto each of the inner surfaces of the plurality of cylinder bores, while generating the stress in the cylinder block by the holding force of the clamp device, to form a thermally sprayed coating on each of the inner surfaces of the plurality of cylinder bores, wherein the stress is generated by the holding force of the clamp device prior to assembling the bearing caps on the cylinder block.

2. The method for manufacturing a cylinder block according to claim 1, wherein, when generating the stress in the cylinder block by the holding force of the clamp device, an inner diameter of at least one of the plurality of cylinder bores is measured, and the deformations of the plurality of cylinder bores are controlled by adjusting the holding force of the clamp device based on the measured inner diameter.

3. The method for manufacturing a cylinder block according to claim 1, wherein the cylinder block is dismounted from the clamp device after the thermally sprayed coating is formed on each inner surface of the plurality of cylinder bores, a crankshaft and the bearing caps are assembled on the cylinder block after carrying out another work process or a test process, and honing is carried out with the thermally sprayed coating formed on each inner surface of the plurality of cylinder bores of the cylinder block on which the crankshaft and the bearing caps are assembled.

4. The method for manufacturing a cylinder block according to claim 1, wherein the clamp device includes a plurality of support protrusions for supporting, from beneath, portions near bearings of the cylinder block on which the bearing caps are to be assembled, and a plurality of clamping mechanisms provided with clamp arms for clamping lower side-edges of the cylinder block from above.

* * * * *